US009033698B2

(12) United States Patent
Leue

(10) Patent No.: US 9,033,698 B2
(45) Date of Patent: May 19, 2015

(54) BURNER FOR UNPROCESSED WASTE OILS

(76) Inventor: Thomas S. Leue, Williamsburg, MA (US)

( * ) Notice: Subject to any disclaimer, the term of this patent is extended or adjusted under 35 U.S.C. 154(b) by 155 days.

(21) Appl. No.: 13/366,507

(22) Filed: Feb. 6, 2012

(65) Prior Publication Data

US 2013/0000533 A1 Jan. 3, 2013

Related U.S. Application Data

(60) Provisional application No. 61/501,830, filed on Jun. 28, 2011.

(51) Int. Cl.

| | |
|---|---|
| ***F23G 7/05*** | (2006.01) |
| ***F23D 11/12*** | (2006.01) |
| ***F23D 11/30*** | (2006.01) |
| ***F23K 5/14*** | (2006.01) |
| ***F23K 5/18*** | (2006.01) |
| ***F23K 5/20*** | (2006.01) |
| ***F23N 1/00*** | (2006.01) |
| ***F23D 11/10*** | (2006.01) |
| ***F23G 5/02*** | (2006.01) |
| ***F23G 5/50*** | (2006.01) |

(52) U.S. Cl.

CPC *F23G 7/05* (2013.01); *F23D 11/12* (2013.01); *F23K 5/142* (2013.01); *F23K 5/18* (2013.01); *F23K 5/20* (2013.01); *F23N 1/002* (2013.01); *F23D 11/10* (2013.01); *F23D 11/30* (2013.01); *F23G 5/02* (2013.01); *F23G 5/50* (2013.01); *F23G 2900/55011* (2013.01); *F23K 2900/05001* (2013.01); *F23N 2025/16* (2013.01)

(58) Field of Classification Search

CPC ..... F23G 7/05; F23G 5/02; F23G 5/50; F23G 2900/55011; F23D 11/30; F23D 11/12; F23D 11/14; F23D 11/10; F23N 1/002; F23N 2025/16; F23K 5/142; F23K 5/18; F23K 5/20; F23K 2900/05001

USPC ..... 110/346, 218, 238, 262, 219; 431/207, 431/209, 354, 11, 12, 89, 214, 330, 356, 431/117, 118; 210/257.1, 293, 477, 499, 210/513, 799, 800, 121, 767; 239/426, 433, 239/434, 533.2

See application file for complete search history.

(56) References Cited

U.S. PATENT DOCUMENTS

| | | | | |
|---|---|---|---|---|
| 513,787 | A * | 1/1894 | Hogan | 210/513 |
| 638,787 | A | 12/1899 | Wolf | |
| 3,421,692 | A | 1/1969 | Babington | |

(Continued)

*Primary Examiner* — Kenneth Rinehart
*Assistant Examiner* — Tavia Sullens
(74) *Attorney, Agent, or Firm* — Ryan, Mason & Lewis, LLP

(57) ABSTRACT

A system and techniques for waste oil combustion are provided. The techniques include straining waste oil, separating contaminants from the strained waste oil to produce segregated layers of waste oil, selectively drawing a segregated layer of the waste oil, entraining the drawn waste oil to a burner for combustion, and regulating flow rate to produce a controllable amount of heat output. The system includes a container for straining waste oil, a storage drum for separating contaminants from the strained waste oil via gravity separation to produce segregated waste oil, an oil uptake channel for entraining the waste oil from the storage drum, a fuel regulator for controlling rate of flow of the waste oil from the storage drum to a burner head via the oil uptake channel, and a burner head control for repositioning a burner head under the input stream to produce a controllable amount of heat output.

17 Claims, 4 Drawing Sheets

(56) References Cited

U.S. PATENT DOCUMENTS

| | | | | | |
|---|---|---|---|---|---|
| 3,421,699 | A | | 1/1969 | Babington | |
| 3,425,058 | A | | 1/1969 | Babington | |
| 4,155,700 | A | | 5/1979 | Babington | |
| 4,253,819 | A | * | 3/1981 | Joret | 431/208 |
| 4,290,888 | A | * | 9/1981 | Gartmann et al. | 210/499 |
| 4,298,338 | A | | 11/1981 | Babington | |
| 4,487,571 | A | * | 12/1984 | Robertson et al. | 431/208 |
| 4,507,076 | A | | 3/1985 | Babington | |
| 4,573,904 | A | | 3/1986 | Babington | |
| 5,149,260 | A | | 9/1992 | Foust | |
| 5,341,832 | A | | 8/1994 | Foust | |
| 5,749,713 | A | * | 5/1998 | Heylbroeck | 431/330 |
| 6,048,197 | A | * | 4/2000 | Beiler | 431/265 |
| 6,364,917 | B1 | | 4/2002 | Matsumura et al. | |
| 2006/0127831 | A1 | * | 6/2006 | Kagi | 431/264 |

* cited by examiner

BURNER FOR UNPROCESSED WASTE OILS

CROSS-REFERENCE TO RELATED APPLICATIONS

The present application claims priority to U.S. Provisional Application Ser. No. 61/501,830, filed Jun. 28, 2011, incorporated by reference herein.

FIELD OF THE INVENTION

Embodiments of the invention generally relate to energy technology, and, more particularly, to fuel sources for conventional heating appliances.

BACKGROUND

Waste oil burners are designed primarily to handle petroleum oils that have been contaminated in the course of their intended uses. Such oils can include motor sump oils, lubricating oils, hydraulic oils, cutting oils, dirty fuel oils, old heating oils, etc. Conventional waste oil burners operate in limited circumstances to capture the embodied energy value of these waste oils for space heating, process heating, hot water production and similar purposes. In existing approaches, the majority of waste oil combustion systems require the waste oil to be pre-filtered to avoid clogging of an orifice dispersion system; that is, a burner system that sprays pre-heated oil through a constricted nozzle so that it atomizes and passes through the path of the igniter.

In existing approaches, the waste oils must also contain relatively trivial amounts of emulsified or suspended water or suspended solids for proper operation. Most power burners that are used in waste oil combustion systems also incorporate an air compressor, a relatively high-pressure pump and one or more electric resistance heaters in the fuel stream, all part of a system that is used to atomize what is otherwise an especially viscous and dense fluid. The atomized droplets are ignited using a high voltage electric spark in the focused mist stream. The burner head (also referred to as a nozzle) is a conventional device by which a liquid fuel stream is atomized. The resulting flame is directed into a heating appliance, such as a boiler or furnace.

However, a need exists in providing an oil burner system that overcomes the tendency of conventional burners to carbonize or otherwise obstruct the orifice of the burner head over time. Additional improvements would reduce the amount of electrical resistance heating, leading to reduced operating costs. Also, reduced fuel preprocessing would save labor and additional costs.

With the lessening of petroleum reserves, there is a need to generate liquid fuels that are made from waste and/or renewable materials. By way of example, in the case of restaurants and food service facilities, waste oil from frying and food processing is typically collected and transported to a rendering plant where the water is removed and the resulting oil is filtered through very narrow mesh (micron) screens and filters or is vacuum-distilled and the resultant refined product is then sold to various users, such as a biodiesel producer. These same restaurants, in order to provide for their domestic hot water needs, might also buy the resulting biodiesel or conventional heating oil for their oil-fired hot water or space-heating appliance.

Accordingly, a need exists to more effectively utilize waste oils on-site for use as fuel to meet energy needs and reduce the need for transport and refinement.

SUMMARY

In one aspect of the present invention, a burner for unprocessed waste oils is provided. An exemplary method (which may be computer-implemented) for performing waste oil combustion, according to one aspect of the invention, can include steps of straining waste oil, separating one or more contaminants from the strained waste oil to produce segregated layers of waste oil, selectively drawing one or more segregated layers of the waste oil, entraining the drawn waste oil to a burner for combustion, and regulating flow rate of the waste oil being entrained to the burner to produce a controllable amount of heat output.

A waste oil combustion system is also provided. The system includes a container for straining waste oil, a storage drum for separating one or more contaminants from the strained waste oil via gravity separation to produce segregated waste oil, an oil uptake channel for entraining a layer of the segregated waste oil from the storage drum, a fuel regulator for controlling rate of flow of the segregated waste oil from the storage drum as an input stream to a burner head via the oil uptake channel, and a burner head control for repositioning a burner head under the segregated waste oil input stream to produce a controllable amount of heat output.

One or more embodiments of the invention or elements thereof can be implemented in the form of an apparatus or system including a feedback system and at least one processor that is coupled to a sensor that controls the rate of delivery of fuel oil to the burner head.

In another aspect, one or more embodiments of the invention or elements thereof can be implemented in the form of means for carrying out one or more of the method steps described herein; the means can include hardware module(s), software module(s), or a combination of hardware and software modules.

These and other objects, features and advantages of the present invention will become apparent from the following detailed description of illustrative embodiments thereof, which is to be read in connection with the accompanying drawings.

DETAILED DESCRIPTION

Figure 1A:
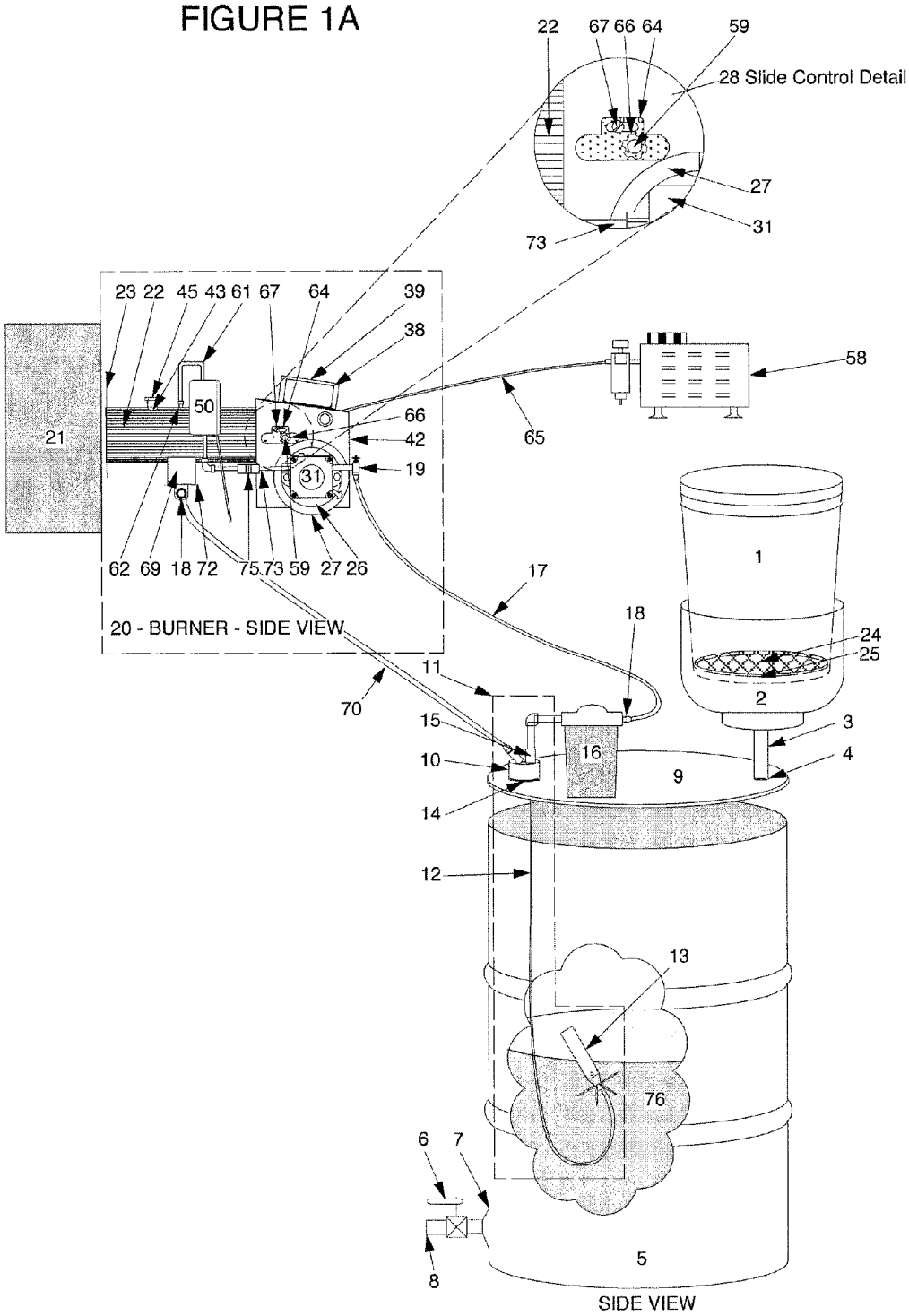
FIG. 1A and FIG. 1B are diagrams illustrating multiple views of a burner for unprocessed waste oil, according to an embodiment of the present invention.

As described herein, an aspect of the present invention includes using waste oils to burn on-site in conventional heating appliances such as furnaces and boilers that typically rely on the combustion of a liquid fuel as the source of heat. Accordingly, an example embodiment of the invention enables the use of unprocessed waste oils as a fuel source in the location where they are generated without pretreatment and without pre-heating. Additionally, an aspect of the invention enables the utilization of many waste oil based fuels without the necessity of small mesh (<100 micron scale) filtering, dewatering, or other pre-processing. An example embodiment of the invention is also capable of operation on conventional heating oils or other processed oils over a wide range of viscosities and heat contents.

Merely as an illustrative example, a restaurant and/or commercial kitchen are described herein in connection with an embodiment of the invention, but it is to be appreciated that the techniques and structures detailed herein can be implemented within the regulatory boundaries in a variety of industries and/or residential settings, and in a variety of combustion systems.

Accordingly, an aspect of the invention includes implementation within a complete fuel handling system that can operate on a wide variety of waste oils as well as conventional heating oils. Such a system can be operated in most circumstances where a conventional liquid fueled burner operates, except, for example, as restricted by codes, laws or conventions. The burner of such a system can also serve, for example, as a functional replacement for packaged oil burners from approximately 20,000 British thermal units (BTUs) per hour up to 300,000 BTUs per hour.

As noted herein, an embodiment of the invention can be implemented as a waste vegetable oil or waste motor oil combustion system due to the ability to handle a wide range of dirty and/or wet waste oils. Also, because of the lessened negative environmental consequences of vegetable oil combustion compared to petroleum combustion, vegetable oil is often a preferred operating fuel. Reduced environmental impacts of vegetable oil based fuel include the near elimination of sulfur compounds, reduced carbon monoxide, reduced potentially carcinogenic N-polycyclic aromatic hydrocarbon (PAH) combustion products and substantially reduced global warming gasses.

The techniques detailed herein can also be carried out with waste or new petroleum oils or a mixture of any of these fuels. All types of vegetable oils and animal fats may be used, and hydrogenated oils or saturated fats that are solid at room temperature may require sufficient heating to liquefy before use.

The description of the equipment and the operating sequence for example embodiments of the invention will be based on the example use of waste vegetable oil in its usual form as generated by a restaurant or commercial kitchen food frying operation. Additionally, as detailed further herein, the system does not require the use of special nozzle cleaning systems, and also does not require the use of outside chemical or physical treatment systems in preparation of the waste oil stream.

At least one embodiment of the invention includes incorporating the physical process of liquid fuel atomization. Regulating this process is accomplished by fine adjustment of the position of the burner head relative to the input fuel stream so that the resulting laminar film of fuel is thicker or thinner when it flows over the air pressure exit port. The regulation process may be accomplished by the user/operator, or by microprocessor controlled mechanical adjustments. This results in the volume of atomized fuel being greater or lesser, and the resulting heat output may be tuned by the user/operator to the needs of the heating system to which the burner is applied. Further, such a design is easily adaptable to most conventional burner chassis designs. These adaptations and original additions to a variety of conventional oil burners constitute a novel aspect and design of embodiments of the invention. Variations in the specific components, such as, for example, the air pressure source, the oil pump speed, or other components are adaptations necessitated by the specific application to which an embodiment of the invention is adapted.

Waste oils from the preparation of foodstuffs are generated in several conventional forms. Waste oils from many kitchens include the degraded edible liquid vegetable oils or animal fats used for deep frying food or other vegetable oil intensive food preparation processes. These oils tend to deteriorate in use after a few days, and are periodically disposed. In many restaurant and/or commercial kitchen settings, these are often the largest source of waste oils by volume. These oils are also referred to herein as Recycled Vegetable Oil (RVO). RVO can often contain a moderate amount of particulate contaminates, less than 10% by volume on average, for example. Also, RVO often has a volume of water entrained, suspended or co-mingled. This water contamination can be an insignificant portion or in the case of operator error, may be up to 99% of the total volume of a given container of "waste oil."

RVO is transported to the input of the system, as detailed herein, by a variety of conveyances. Open-topped buckets or trays may transport RVO from the fryers where the RVO has been declared surplus. A restriction can exist in the form of a temperature limit on the RVO so that any plastic components of the system are not heat damaged. For example, this can mean a temperature limit of less than 150 degrees Fahrenheit (F).

A second common conveyance includes an approximately five-gallon disposable plastic jug that is often used in the retail distribution of edible vegetable oil. These jugs can be refilled with RVO and are often accumulated for disposal at the kitchen site. Also, they often demonstrate the gravity separation of the contents into multiple layers of varying density showing the separation of water, particulate matter and RVO. Although some decanting of the uppermost layer of RVO is desirable, it is not required for the normal operation of one or more embodiments of the invention. The disposable jugs can be opened and upended into the input side of the system in normal operation.

Other input options can include the direct piping of RVO from its source into the system, according to one or more embodiments of the invention. This type of connection is often available as an option for eating establishments that install a continuous cleaning system for frying oil operations. Additionally, as described herein, once the fuel is transported to a system encompassing an embodiment of the invention, the fuel pathway within the embodiment of the invention is required for operation.

Figure 1B:
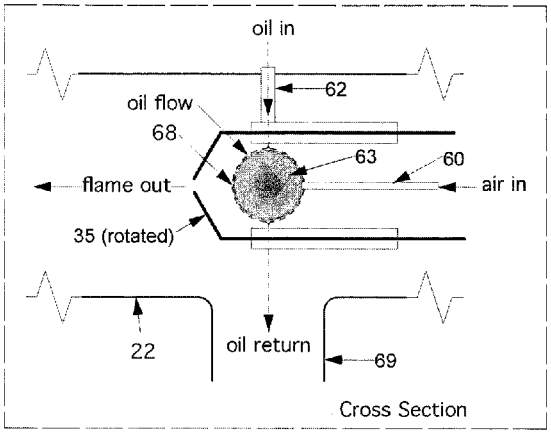
Figure 1B:
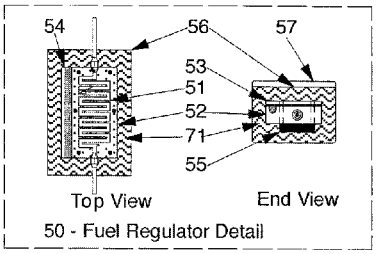
Figure 1B:
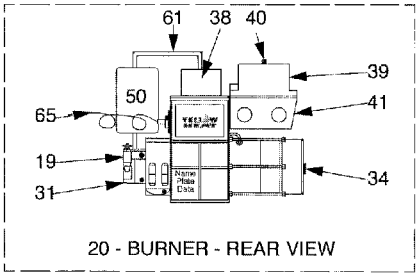
Figure 1B:
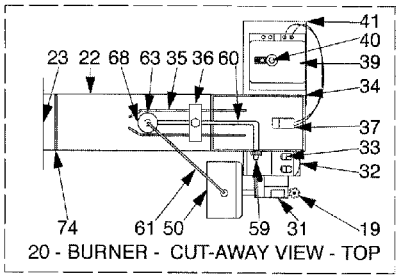

FIG. 1A and FIG. 1B are diagrams illustrating multiple views of a burner for unprocessed waste oil, according to an embodiment of the present invention. As depicted in FIG. 1A and FIG. 1B, As depicted in FIG. 1, input fuel and any associated contaminants are entered into the system through the straining bucket (1). In an example embodiment of the invention, the straining bucket (1) can be a new or recycled 5-gallon poly pail, which can be modified by cutting or removing a disk out of the bottom (25) (or using a similarly pre-constructed item), leaving a lip of ½-inch width or similar as a continuous support. Additionally, the conveyance mechanisms described above are used to transport the waste oil into straining bucket (1).

To the bucket structure, a disk of stainless steel, woven-wire mesh (24) of various mesh sizes (for example, 40 mesh or 380 micron openings) can be attached by welding or other means. Straining bucket (1) removes particulate matter larger than the mesh openings and accumulates a large percentage of emulsions, semi-solid colloids, congealed fine particulate pastes and other larger contaminants. To a large extent, water and RVO pass through the straining bucket (1) unimpeded. Further, in at least one embodiment of the invention, the straining bucket (1) can be removed and cleaned by a variety of methods, including gravity after inversion and hot air blast treatment.

The RVO and water, both potentially contaminated with fine particulate matter, are channeled via a wide-mouth drum funnel (2) (for example, a custom fabricated funnel capable of holding the base of the straining bucket (1)) that is connected to a short length (for example, 3") of steel pipe nipple (for example, ¾" national pipe thread (NPT)) (3). This pipe nipple, in turn, is connected into the (for example, ¾") bung hole (4) of a fuel storage drum (5) (for example, a 55-gallon steel drum modified as a storage container supplied as a part of such a system or other fuel storage container. The modified drum includes a bottom drain, such as a ball valve (6) (for example, a ½" ball valve) connected to the sidewall near the base of the drum to a welded (for example, ½") tank fitting (7). This bottom drain serves to remove accumulated water from the system via component (8).

As should be appreciated by one skilled in the art, while FIG. 1A and FIG. 1B depict an example embodiment of the invention, any fuel container that encourages gravity separation of the fuel and the contaminants may be used in embodiments of the invention.

As also depicted in FIG. 1A and FIG. 1B, a removable drum lid (9) can have, for example, a 2" fitting threaded into a 2" bung hole (14). This 2" fitting is part of a sub-assembly referred to as a floating draw-off (11). Additionally, 2" is merely identified here within the context of this example embodiment, and it is to be appreciated that other sizes can be implemented according to the related components of an embodiment of the invention.

The floating draw-off (11) includes an assembly (10) (for example, a brass assembly) with flow channels, associated tubing and a float. The purpose is to allow the uptake of the topmost layer of fuel from the storage drum without entraining the lower layers that may be burdened with the largest percentage of contaminants. In an example embodiment of the invention depicted, multiple channels manage additional flow streams, including the stream of excess fuel as it is returned from the burner head because not all of the fuel delivered to the burner head is consumed in any one pass.

The fuel uptake channel (for example, component(s) of floating draw-off (11) in FIG. 1A) is connected on the underside to a length of compatible flexible hose (12). In one or more embodiments of the invention, the hose (12) is the length of the sum of the height and width of the fuel storage drum (5) and is connected on its distal end to a float (13) of sufficient buoyancy to support the sum of the weights of the hose, the float and the liquid contents without being completely submerged. Approximately 1" below the distal end of the float are a series of side vents to allow uptake of the liquid fuel (76) from the uppermost section of fuel reservoir in the fuel storage drum (5). Because any co-mingled contaminants in the fuel are likely water and particulate matter, both denser than RVO, such contaminants tend to settle towards the bottom of the fuel storage drum (5). The floating draw-off (11) entrains the cleanest and driest fuel in the fuel storage drum (5). Accumulated water and/or persistent emulsions, if any, are removed by use of the bottom drain. These materials are waste streams that require disposal.

The fuel is sucked into the burner pump (for example, component (31) in FIG. 1A and FIG. 1B) through a check valve (15) in the floating draw-off (11) and through a series of pipe-fittings (as depicted as part of component (11) in FIG. 1A) to a suction fuel strainer (16) with an internal mesh screen (for example, a 140 micron stainless steel mesh screen). This screen removes smaller particulate matter and more suspended colloids and congealed fats to protect the pump. Many hours of operation with various grades of contaminated oil has shown that due to the location of the intake of fuel in the drum, cleaning of the fuel path, for example, can be as infrequent as annually. The screens in the fuel path may be washed and reused.

The outlet of the suction fuel strainer (16) is connected to a fuel supply tube (17) (for example, a metal fuel supply tube) with flared connectors (18). In at least one embodiment of the invention, the fuel supply tube (17) is long enough to reach the burner that is installed in the heating appliance. The fuel supply tube (17) is rigidly connected from the floating draw-off (11) to the fuel input firematic valve (19) of the burner in a vacuum tight manner.

The burner (20) can be installed in an oil-fired heating appliance (21) of choice, such as a boiler or furnace. The installation can conform to the industry standards, for example, with a commonly used 4" diameter steel thin-wall tubing fire tube (22) bolted in place to a furnace flange (23). As is to be appreciated by one skilled in the art, other embodiments of the invention can include custom installations for other purposes. Appliances and controls located downstream of the fire tube (22) can be, for example, supplied by others and not be included as a part of this system.

An example embodiment of the invention can include utilizing mostly standard, unmodified configurations and subsystems found in the operation and control of conventional liquid fueled combustion devices. On the opposite end of the fire tube (22) from the heating appliance can be industry standard combustion controls and safety systems. These can include the fire eye (37), which confirms the presence of a flame, the controller (39), which acts as a logic circuit for flame control, and the firematic valve (19), which acts as a temperature-limiting safety valve.

Such components can include a waste oil pump (31), a combustion air fan (32) with air shutter (33), an electric motor (34), electrodes (35), electrode holders (36), a fire eye (37), an igniter (38), a burner controller (39) with on-off control (40), an electrical box (41), an oil supply tube (61), firematic valve (19), and burner chassis (42). In one or more embodiments of the invention, the burner controller (39) controls the motor (34), electrodes (35) spark, blower (27) and the fuel pump (31). The controller (39) can also serve as the primary safety system for burner operation. The modification of some of these elements can be included in the burner of one or more embodiments of the invention. As an example, the industry offers several varieties of each of these components for particular purposes. Many, if not all, of these components can be functional with an embodiment of the invention as described herein. Further, in an aspect of the invention, one or more portions of the techniques described herein can be implemented in the form of software or firmware that controls the controller (39).

The fire tube (22) has an electrode port (43) located above the distal end of the electrodes. Due to the tendency of RVO to carbonize the electrodes, this electrode port (43) provides access for periodic cleaning. In an example embodiment of the invention, it is constructed with a threaded hole in which is a ¾" threaded plug (45).

As depicted in FIG. 1A and FIG. 1B, oil from the oil storage drum (5) via the floating draw-off (11) enters the oil pump (31) via a firematic valve (19). In an example embodiment of the invention, the pump has a 280-micron +/− intake screen that has been protected from clogging by the suction fuel strainer (16).

The fuel pump outlet (73) is piped through a check valve (75) to the fuel regulator (50), which includes a square-wave sinusoidal flow channel (51) machined in a metal (for example, aluminum) block (52) with a gasketed cover (53).

The flow channel (51) serves to slow the flow of oil to the burner without creating a constriction that might lead to clogging due to the solid contents of the fuel stream. The flow channel (51) is created by use of multiple changes of flow direction, which create resistance to flow. The changes of direction can be in the form of a sinusoidal pattern or other complex pattern. An electric cartridge heater (54) operates on a thermostat (55), transferring thermal energy to the fuel along its passage. This serves to reduce viscosity in the fuel and improve ignition and combustion through improved dispersion. In an example embodiment of the invention, the fuel exit temperature is controlled at 160 degrees Fahrenheit (F) (+/−). The fuel regulator (50) is contained within insulation (71) in a metal box (56) with a metal cover (57).

Additionally, in at least one embodiment of the invention, a low pressure, low volume standard air compressor (58) is a component of the burner.

For example, the air compressor operates whenever the burner is in operation and supplies 20 to 40 pounds per square inch (psi) air through a pressure tube (65) at one to two cubic feet per minute (CFM) to the compressed air inlet (59) on the burner. The compressed air inlet (59) is on one end of the pressure tube (60), which can be identical in design and location to an oil supply tube in conventional oil burners, and which can be repurposed in one or more embodiments of the invention.

The outflow from the fuel regulator (50) is connected to an oil supply tube (61) and then to an inlet fitting (62) on the fire tube (22). The inlet fitting (62) is located directly above the center of the burner head (63) on the end of the pressure tube (60).

The positions of the pressure tube (60) and the burner head (63) are adjustable within a defined range relative to the position of the inlet fitting (62) via a slide control (64) located where the compressed air line (65) is connected on the wall of the burner chassis (42). This adjustment allows the fuel stream to flow over the surface of the burner head either closer or farther away from the spray hole outlet, consequently resulting in a larger amount or a lesser amount of fuel spray. In at least one embodiment of the invention (and as further illustrated in the magnified slide control detail (28) in FIG. 1), both a knurled ring (66) and a setscrew (67) control the position of the pressure tube assembly for short-term adjustment and long-term position locking, respectively. The forward or backward positioning of the slide control is the ultimate control of the fuel feed and the consequent heat output.

Additionally, in connection with at least one embodiment of the invention, a principal of operation is known as the Babington Principal. As used herein, the Babington Principal is a design for a nebulizing sprayer as a nozzle for aspirating varying viscosity liquid fuels by means of a small diameter jet of compressed air disrupting the laminar flow of liquid film as it travels by gravity across a curved surface. The liquid is metered onto the upside pole of a hollow steel spherical surface, a "Babington Ball" (63) of approximately 1½" diameter. Flowing down the surface, it is essentially a laminar film. Into this hollow ball enters the compressed air flowing from the pressure tube (60). The Babington Ball (63) is threaded onto the end of the pressure tube (60). On the opposite side of the Babington Ball is a spray hole (for example, with dimensions of approximately 0.010" across) or slit (for example, with dimensions of approximately 0.10" long by 0.006" width) (68) cut through the outside wall of the Babington Ball. Due to the shearing action of the compressed air exiting the Babington Ball, the portion of the fuel film in the vicinity of the spray slit (68) is atomized in a continuous fine mist spray in the direction of the compressed air stream and the airstream from the combustion air fan (32).

At a gauged distance (of, in an example embodiment of the invention, approximately ½") from the surface of the Babington Ball are two electrodes (35) with a 14,000-volt or greater energy potential provided by the igniter (38). This produces a continuous spark across an air gap that is able to ignite the fuel mist into complete combustion. The portion of the fuel that travels on a different path to the downside pole of the Babington Ball is not burned and is channeled to an oil sump (69) in the fire tube (22). The fire tube (22) in the industry standard is a 4" diameter steel pipe of a variable length. This can be modified in at least one embodiment of the invention by the addition of a sump (69), an inspection port (45), a fuel inlet (62) and crescent shaped tube end baffles (74) that serve to retain any over-spray liquid fuel and help it return to the sump (69).

The flame path of the burning fuel is directed by a combination of the compressed air stream, the combustion air stream and the natural draft of the heating appliance through a conventional appliance chimney. This movement is sufficient to draw the flame front into the heating appliance and accomplish the intended work of heating the appliance. Combustion air is controlled by an adjustable shutter (26) that surrounds a squirrel cage type blower (27), allowing the total forced draft to be balanced to the air consumption requirements of the fuel feed rate for optimum combustion efficiency.

The return oil stream from the oil sump (69) back to the fuel storage drum (5) via a return oil tube (70) can be accomplished in different ways based on the differential elevation of the oil sump (69) and the top of the fuel storage drum (5). For example, when the oil sump (69) is higher than the top of the fuel storage drum (5), the return oil stream is allowed to flow back to the lower channel of the floating draw-off (11) that is designed for return oil flow via hollow metal tubing and flare fittings.

Additionally, when the oil sump (69) is lower than the top of the fuel storage drum (5), the oil is pumped by use of a second pump that draws the oil from the oil sump (69) and returns it to the storage drum (5).

Most of the particulate food solids that may be contaminants of the waste oil that is combusted are burned up in the combustion of the atomized oil once it leaves the surface of the Babington Ball and passes through the igniter (38), where the solids' energy content contributes to the overall system thermal output. Any debris that is delivered to the upward pole of the Babington Ball that is not involved in the combustion is washed off the downward pole into the oil sump (69). This debris is then returned to the fuel storage drum (5) via the return oil tube (70) where it may settle. The oil sump (69) has a removable base (72) to allow for cleaning any accumulated debris.

Additionally, a computer interface is included in one or more embodiments of the invention. The input signal is based on thermal sensors located on the surface of the firebox, the heat exchanger and/or the chimney. The output of the computer system may be used to adjust or modify the controller (39). The computer system may also be used to adjust other aspects of the system, such as the mechanical position of the air tube (60) or the speed of the motor (34). These approaches have the same goal of controlling the amount of oil that is aspirated and thereby controlling the heat output.

Also, the fire tube (22) is clamped or otherwise secured to the flange mounted on the heating appliance.

Figure 2:
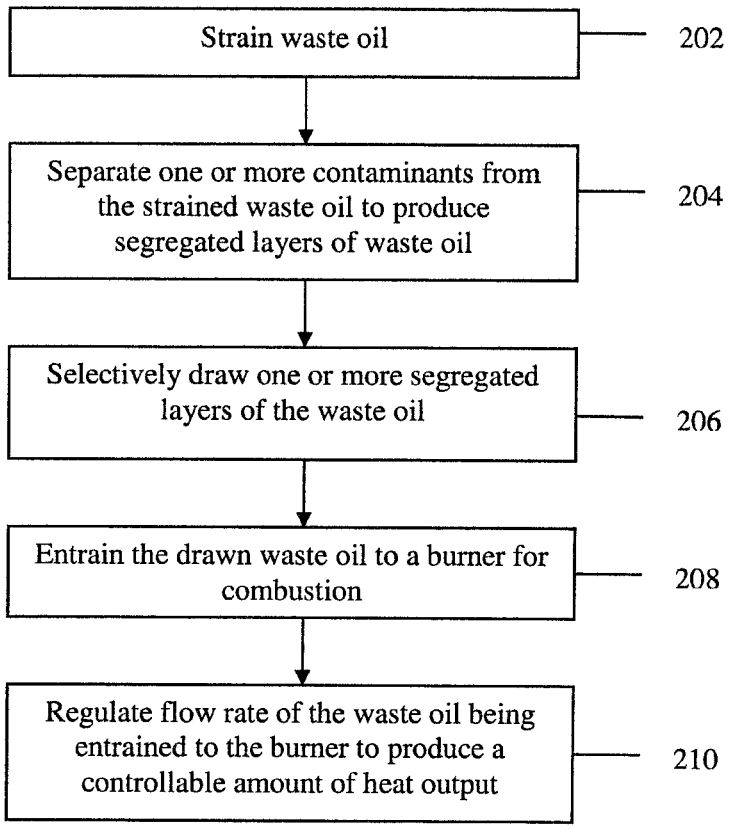
FIG. 2 is a flow diagram illustrating techniques for performing waste oil combustion, according to an embodiment of the present invention.

FIG. 2 is a flow diagram illustrating techniques for performing waste oil combustion, according to an embodiment of the present invention. Step 202 includes straining waste oil. In an example embodiment of the invention, straining waste oil can include using a container fitted with a mesh to act as a strainer. Step 204 includes separating one or more contaminants from the strained waste oil to produce segregated layers of waste oil. Separating contaminants from the strained waste oil can include facilitating gravity separation of one or more contaminants from the strained waste oil.

Step 206 includes selectively drawing one or more segregated layers of the waste oil. Selectively drawing segregated layers of the waste oil can include utilizing a different specific gravity of the waste oils, water contaminants and the particulate matter. Selectively drawing one or more segregated layers of the waste oil can include drawing a topmost layer of waste oil from the segregated layers of waste oil without drawing one or more lower layers of waste oil that contain a larger percentage of contaminants. Step 208 includes entraining the drawn waste oil to a burner for combustion.

Step 210 includes regulating flow rate of the waste oil being entrained to the burner to produce a controllable amount of heat output (for example, through viscosity control and flow channel friction). Regulating flow rate of the waste oil being entrained to the burner to produce a controllable amount of heat output can include controlling positioning of the burner head under a fuel input stream.

The techniques depicted in FIG. 2 can also include removing decontaminated waste oil after one or more contaminants are removed.

Additionally, at least one embodiment of the invention can include atomizing the waste oil at a burner head for complete combustion. As appreciated by one skilled in the art, oil will cleanly burn in a liquid form when the oil droplets are sufficiently small (for example, on the order of 50 microns). Also, a pool of liquid oil will likely not ignite below its ignition temperature of around 350 degrees Fahrenheit. Accordingly, without complete combustion, a unit can possibly produce non-trivial amounts of smoke (potentially in violation of pollution regulation) and waste significant amounts of energy in the process. As used herein, "complete" combustion is an industry standard of approximately 80% to 90% combustion.

The techniques depicted in FIG. 2 can also include facilitating open-channel flow of the waste oil without restriction subject to clogging by debris. Also, an aspect of the invention includes regulating the waste oil for viscosity control.

Additionally, one or more embodiments of the invention can be implemented in the form of an apparatus or system including a feedback system and at least one processor that is coupled to a sensor that controls the rate of delivery of fuel oil to the burner head.

Figure 3:
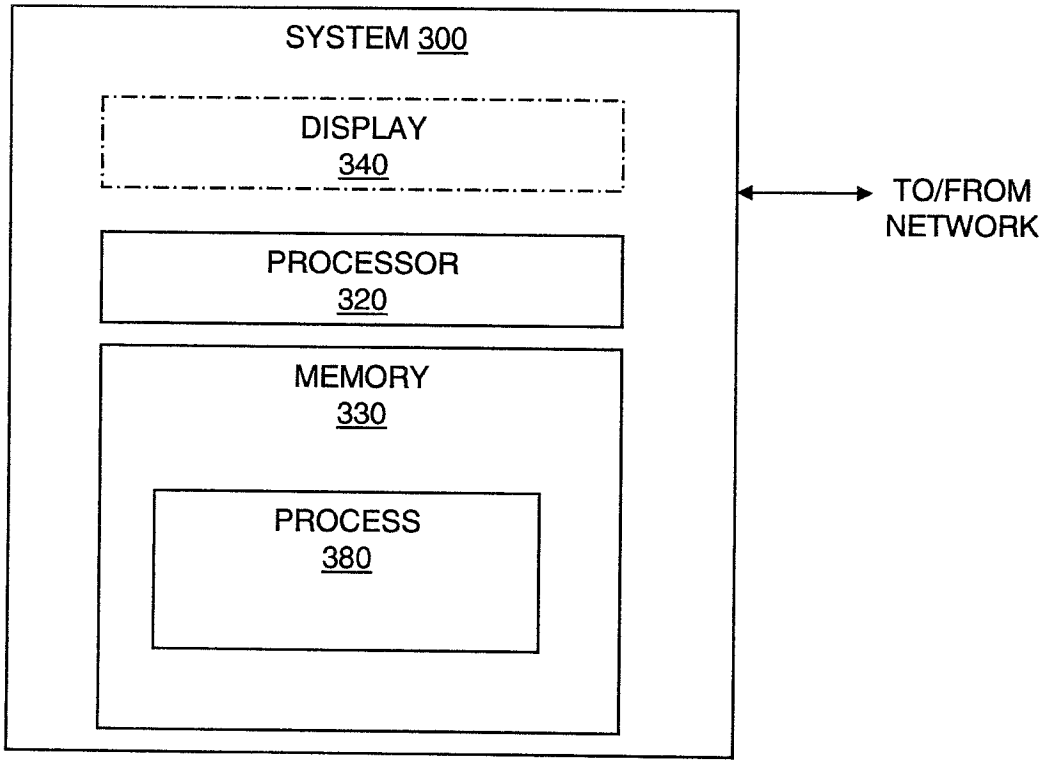
FIG. 3 is a system diagram of an exemplary computer system on which at least one embodiment of the present invention can be implemented.

Aspects of the invention (for example, controller (such as component 39 in FIG. 1A and FIG. 1B) or a workstation or other computer system to carry out design methodologies) can employ hardware and/or hardware and software aspects. Software includes but is not limited to firmware, resident software, microcode, etc. FIG. 3 is a block diagram of a system 300 that can implement part or all of one or more aspects or processes of the invention. As shown in FIG. 3, memory 330 configures the processor 320 to implement one or more aspects of the methods, steps, and functions disclosed herein (collectively, shown as process 380 in FIG. 3). Different method steps could theoretically be performed by different processors. The memory 330 could be distributed or local and the processor 320 could be distributed or singular. The memory 330 could be implemented as an electrical, magnetic or optical memory, or any combination of these or other types of storage devices. It should be noted that if distributed processors are employed, each distributed processor that makes up processor 320 generally contains its own addressable memory space. It should also be noted that some or all of computer system 300 can be incorporated into an application-specific or general-use integrated circuit. For example, one or more method steps could be implemented in hardware in an application-specific integrated circuit (ASIC) rather than using firmware. Display 340 (optional) is representative of a variety of possible input/output devices.

As is known in the art, part or all of one or more aspects of the methods and apparatus discussed herein may be distributed as an article of manufacture that itself comprises a tangible computer readable recordable storage medium having computer readable code means embodied thereon. The computer readable program code means is operable, in conjunction with a processor or other computer system, to carry out all or some of the steps to perform the methods or create the apparatuses discussed herein. A computer-usable medium may, in general, be a recordable medium (for example, floppy disks, hard drives, compact disks, EEPROMs, or memory cards) or may be a transmission medium (for example, a network comprising fiber-optics, the world-wide web, cables, or a wireless channel using time-division multiple access, code-division multiple access, or other radio-frequency channel). Any medium known or developed that can store information suitable for use with a computer system may be used. The computer-readable code means is any mechanism for allowing a computer to read instructions and data, such as magnetic variations on a magnetic medium or height variations on the surface of a compact disk. The medium can be distributed on multiple physical devices (or over multiple networks). As used herein, a tangible computer-readable recordable storage medium is intended to encompass a recordable medium, examples of which are set forth above, but is not intended to encompass a transmission medium or disembodied signal.

The computer system can contain a memory that will configure associated processors to implement the methods, steps, and functions disclosed herein. The memories could be distributed or local and the processors could be distributed or singular. The memories could be implemented as an electrical, magnetic or optical memory, or any combination of these or other types of storage devices. Moreover, the term "memory" should be construed broadly enough to encompass any information able to be read from or written to an address in the addressable space accessed by an associated processor. With this definition, information on a network is still within a memory because the associated processor can retrieve the information from the network.

Thus, elements of one or more embodiments of the invention, such as, for example, the controller, can make use of computer technology with appropriate instructions to implement method steps described herein.

As also detailed herein, the output of the computer system may be used to adjust or modify the controller (component 39 in FIG. 1A and FIG. 1B), as well as be used to adjust other aspects of the system of at least one embodiment of the invention, such as the mechanical position of the air tube (component 60 in FIG. 1B) or the speed of the motor (component 34 in FIG. 1B).

Accordingly, it will be appreciated that one or more embodiments of the present invention can include a computer program comprising computer program code means adapted to perform one or all of the steps of any methods or claims set forth herein when such program is run on a computer, and that such program may be embodied on a computer readable medium. Further, one or more embodiments of the present invention can include a computer comprising code adapted to cause the computer to carry out one or more steps of methods or claims set forth herein, together with one or more apparatus elements or features as depicted and described herein.

It will be understood that processors or computers employed in some aspects may or may not include a display, keyboard, or other input/output components. In some cases, an interface can be provided (for directing operation of the system, displaying instructions, results, etc.).

Thus, while there have shown and described and pointed out fundamental novel features of the invention as applied to exemplary embodiments thereof, it will be understood that various omissions and substitutions and changes in the form and details of the devices illustrated, and in their operation, may be made by those skilled in the art without departing from the spirit of the invention. Moreover, it is expressly intended that all combinations of those elements and/or method steps which perform substantially the same function in substantially the same way to achieve the same results are within the scope of the invention. Furthermore, it should be recognized that structures and/or elements and/or method steps shown and/or described in connection with any disclosed form or embodiment of the invention may be incorporated in any other disclosed or described or suggested form or embodiment as a general matter of design choice. It is the intention to be limited only as indicated by the scope of the claims appended hereto.

What is claimed is:

1. A waste oil combustion system, comprising:

a container for straining waste oil;

a storage drum for separating one or more contaminants from the strained waste oil via gravity separation to produce segregated waste oil;

an oil uptake channel for entraining a layer of the segregated waste oil from the storage drum;

a fuel regulator for controlling a rate of flow of the segregated waste oil from the storage drum as an input stream to a burner head via the oil uptake channel, wherein said fuel regulator comprises a sinusoidal flow channel incorporating multiple changes of flow direction; and a burner head control for repositioning a burner head relative to the flow of the segregated waste oil input stream to produce a controllable amount of heat output, wherein the burner head comprises a hollow spherical structure with an outlet through which a stream of compressed air exits the hollow spherical structure, wherein the outlet is positioned at the equator line of the spherical structure, and wherein said repositioning the burner head comprises repositioning the spherical structure and the outlet thereof within a defined horizontal range such that the flow of the segregated waste oil, comprising a laminar film of the segregated waste oil metered onto the spherical structure at approximately the north pole of the spherical structure, travels across the curved surface of the spherical structure towards the equator line, resulting in a controllable thickness of the portion of the laminar film of the segregated waste oil travelling across the outlet to be atomized by the stream of compressed air exiting through the outlet.

2. The system of claim 1, wherein the container for straining waste oil comprises a container fitted with a mesh to act as a strainer.

3. The system of claim 2, wherein the container includes a removed bottom horizontal portion and a horizontal lip onto which the mesh is attached.

4. The system of claim 3, wherein the container for straining waste oil comprises a stainless steel woven-wire mesh screen attached to the horizontal lip via plastic welding along a perimeter of the horizontal lip.

5. The system of claim 1, wherein the oil uptake channel for entraining a layer of the segregated waste oil from the storage drum uptakes a topmost layer of waste oil from the storage drum without entraining one or more lower layers of waste oil from the storage drum.

6. The system of claim 1, further comprising:

a floating draw-off for removing decontaminated waste oil after one or more contaminants are removed.

7. The system of claim 1, wherein the fuel regulator controls rate of flow of the waste oil to a burner head without a constriction subject to clogging with debris.

8. The system of claim 7, wherein the fuel regulator controls viscosity of the waste oil via a regulated thermal input system.

9. The system of claim 1, wherein the heat output is controlled based on at least one of user preference and a setting to tune the heat output to an appliance capacity.

10. The system of claim 1, wherein the burner head control regulates an amount of waste oil film to be atomized by a pressurized air jet stream.

11. A method for performing waste oil combustion, comprising the steps of:

straining waste oil;

separating one or more contaminants from the strained waste oil to produce segregated layers of waste oil;

selectively drawing one or more segregated layers of the waste oil;

entraining the drawn waste oil through a sinusoidal flow channel incorporating multiple changes of flow direction to a burner head for combustion at a rate of flow, wherein the burner head comprises a hollow spherical structure with an outlet through which a stream of compressed air exits the hollow spherical structure, wherein the outlet is positioned at the equator line of the spherical structure; and controlling an amount of heat output by repositioning the burner head relative to the flow of the drawn waste oil, wherein said repositioning the burner comprises repositioning the spherical structure and the outlet thereof within a defined horizontal range such that the flow of the drawn waste oil, comprising a laminar film of the drawn waste oil metered onto the spherical structure at approximately the north pole of the spherical structure, travels across the curved surface of the spherical structure towards the equator line, resulting in a controllable thickness of the portion of the laminar film of the drawn waste oil travelling across the outlet to be atomized by the stream of compressed air exiting through the outlet.

12. The method of claim 11, wherein separating one or more contaminants from the strained waste oil comprises facilitating gravity separation of one or more contaminants from the strained waste oil.

13. The method of claim 11, further comprising:

facilitating open-channel flow of the waste oil without restriction subject to clogging by debris.

14. The method of claim 11, further comprising:

regulating the waste oil for viscosity control.

15. The method of claim 11, wherein selectively drawing one or more segregated layers of the waste oil comprises drawing a topmost layer of waste oil from the segregated layers of waste oil without drawing one or more lower layers of waste oil that contain a larger percentage of contaminants.

16. The method of claim 11, wherein straining waste oil comprises using a container fitted with a mesh to act as a strainer.

17. The method of claim 11, further comprising:

removing decontaminated waste oil after one or more contaminants are removed.

* * * * *

UNITED STATES PATENT AND TRADEMARK OFFICE

CERTIFICATE OF CORRECTION

PATENT NO. : 9,033,698 B2
APPLICATION NO. : 13/366507
DATED : May 19, 2015
INVENTOR(S) : Thomas S. Leue It is certified that error appears in the above-identified patent and that said Letters Patent is hereby corrected as shown below:

IN THE SPECIFICATION

In Column 4, line 49, remove "As depicted in FIG. 1," before "input fuel" and after "FIG. 1B".

Signed and Sealed this
Eighth Day of March, 2016

Michelle K. Lee

Michelle K. Lee
*Director of the United States Patent and Trademark Office*